US005477306A

United States Patent [19]

Iguchi et al.

[11] Patent Number: 5,477,306

[45] Date of Patent: Dec. 19, 1995

[54] DETACHABLE PROCESS UNIT FOR AN ELECTROPHOTOGRAPHIC DEVICE

[75] Inventors: Michihisa Iguchi; Seiji Arai; Chinobu Sakai; Takahito Kabai; Satoshi Katagata, all of Tokyo, Japan

[73] Assignee: Kabushiki Kaisha Toshiba, Kawasaki, Japan

[21] Appl. No.: 114,099

[22] Filed: Aug. 31, 1993

[30] Foreign Application Priority Data

Sep. 1, 1992 [JP] Japan ..... 4-233926

[51] Int. Cl.[6] ..... G03G 13/00; G03G 15/00; G03G 15/30; G03G 15/04

[52] U.S. Cl. ..... 355/210; 347/130; 347/152; 355/200; 355/219; 355/221; 355/229

[58] Field of Search ..... 355/200, 212, 355/210, 211, 245, 272, 326 R, 233, 219, 221, 228, 229; 250/324–326; 361/225, 212, 213, 229, 230; 347/130, 152

[56] References Cited

U.S. PATENT DOCUMENTS 4,757,342 7/1988 Ogura et al. ..... 355/211
4,963,928 10/1990 Yoshiura ..... 355/210
5,204,713 4/1993 Yamamura ..... 355/210
5,216,465 6/1993 Arai et al. ..... 355/210
5,291,249 3/1994 Lee ..... 355/210 X
5,345,294 9/1994 Nomura et al. ..... 355/200

*Primary Examiner*—A. T. Grimley
*Assistant Examiner*—Shuk Y. Lee
*Attorney, Agent, or Firm*—Finnegan, Henderson, Farabow, Garrett & Dunner

[57] ABSTRACT

In an electrophotographic device, a main body is divided into a lower body and a swingable upper body. A process unit formed of at least a toner holder, a charger, and a developer is detachably mounted in the lower body. The position of the process unit (particularly, the photosensitive member) relative to the lower body (particularly, a member driving gear) is controlled by placing a shaft of the member through a groove in a side wall of the lower body at one end of the member, and by bringing a lower end of the side wall of the process unit supporting the member into contact with an upper end of a support member supporting the member driving gear. An exposure unit mounted in the upper body is positioned to the photosensitive member with a predetermined distance therebetween by bringing a contact portion of the exposure head into contact with the side wall of the lower body supporting the member.

20 Claims, 7 Drawing Sheets

DETACHABLE PROCESS UNIT FOR AN ELECTROPHOTOGRAPHIC DEVICE

BACKGROUND OF THE INVENTION

1. Field of the Invention

The present invention relates to an electrophotographic device fen which a main body is formed of a lower body and an upper body such that a photosensitive drum is easily replaced.

2. Description of the Related Art

In an electrophotographic device, a photosensitive drum will inevitably deteriorate as it is used, and thus must be replaced with a new one every predetermined period of time. Therefore, the photosensitive drum is mounted in the device such that the drum can easily be detached therefrom. In general, to facilitate replacing of the photosensitive drum, the main body is formed of a lower body mounting the photosensitive drum and a swingable upper body. When the upper body is opened, a used photosensitive drum is detached from the lower body and a new photosensitive drum is mounted therein.

With this structure, the photosensitive drum is easily displaced from a regular position. Displacement of the drum relative to the upper and lower bodies may adversely affect the quality of image. For example, such displacement may cause a driven gear secured to the drum, to be wrongly meshed with a driving gear for transmitting a driving force generated by a motor mounted in the lower body to the drum, inducing unstable rotation of the drum. As a result, jitter appears on the image. Further, a light beam emitted from an exposure unit mounted in the upper body cannot be exactly focused on the surface of the drum due to the displacement of the drum. This results in blurring of the image.

SUMMARY OF THE INVENTION

It is a first object of the present invention to provide an electrophotographic device in which the position of a photosensitive drum is maintained constant with respect to a main body which is formed of a lower body and an upper body, so as to produce a high quality image.

It is a second object of the present invention to provide an electrophotographic device in which a charger is attached to a photosensitive drum and in which an electrical connection between the charger and a main body is easily performed when the charger as well as the photosensitive drum are mounted to a main body.

According to the present invention, there is provided an electrophotographic device comprising:

exposure means for emitting light in accordance with an image;

driving means for providing a rotational force;

first supporting means for supporting said driving means; and a process unit including:

a photosensitive member, on which a latent image is formed by the light emitted from said exposure means, the photosensitive member being driven by the rotational force provided from said driving means; and second supporting means for supporting said photosensitive member, the second supporting means having a first positioning member for contacting said first supporting means and a second positioning member for contacting said exposure means.

According to the present invention, there is further provided an electrophotographic device comprising:

a photosensitive member;

a charger for charging the surface of the photosensitive member;

a support member for supporting the photosensitive member and the charger, the support member being detachably mounted in a main body of the electrophotographic device; and a first conductive member arranged in said support member, the first conductive member having a first portion and a second portion, the first portion contacting said charger and the second portion contacting a second conductive member disposed in the main body of the electrophotographic device when said support member is mounted in the main body of the electrophotographic device.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

A preferred embodiment of an electrophotographic device according to the present invention will now be described with reference to the accompanying drawings. Hereinafter, a facsimile apparatus is explained as an example of the electrophotographic device.

Figure 1:
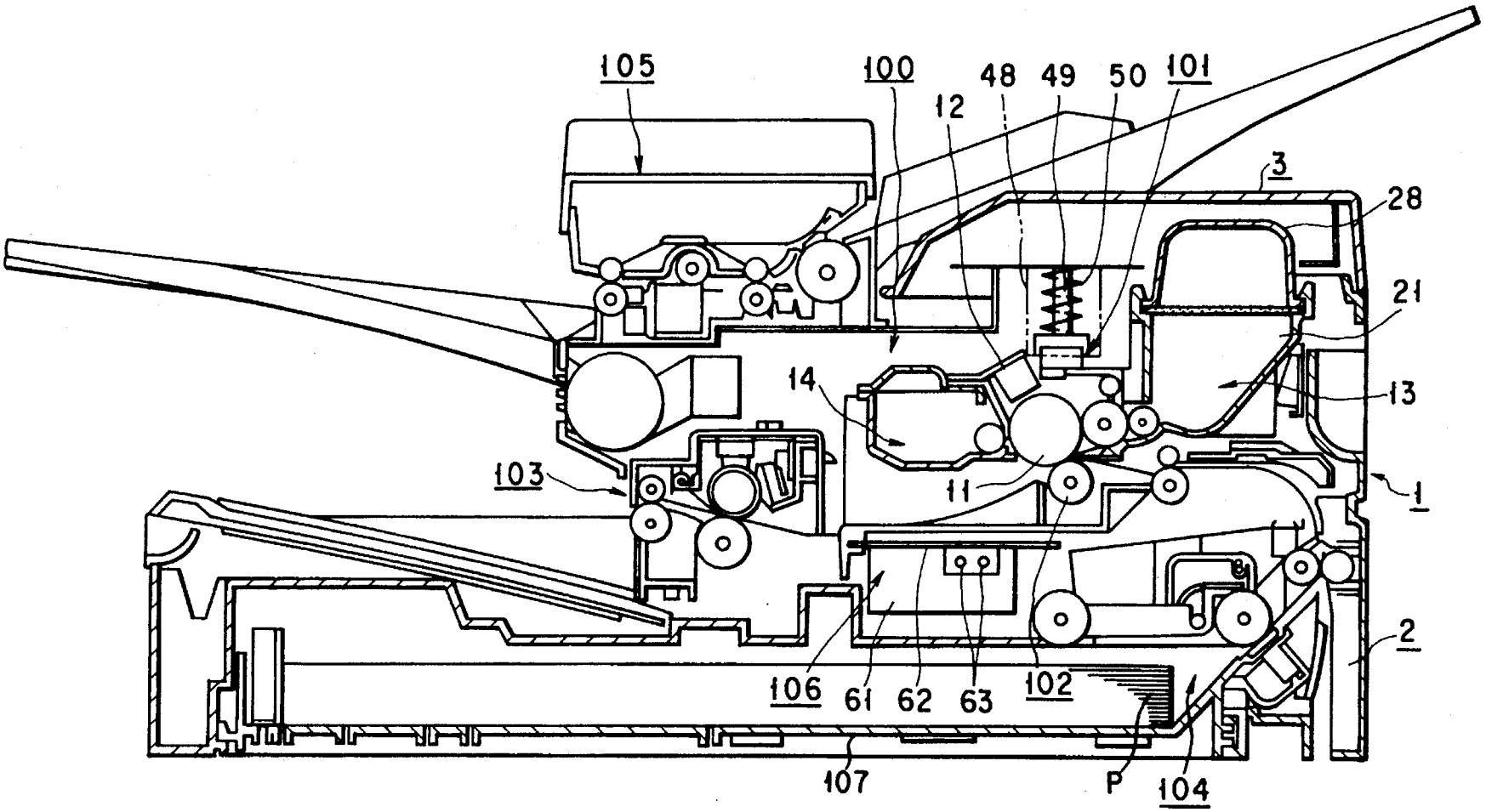
FIG. 1 is a cross-sectional view, showing the overall arrangement of a facsimile device equipped with an embodiment of an electrophotographic device according to the present invention.
Figure 2:
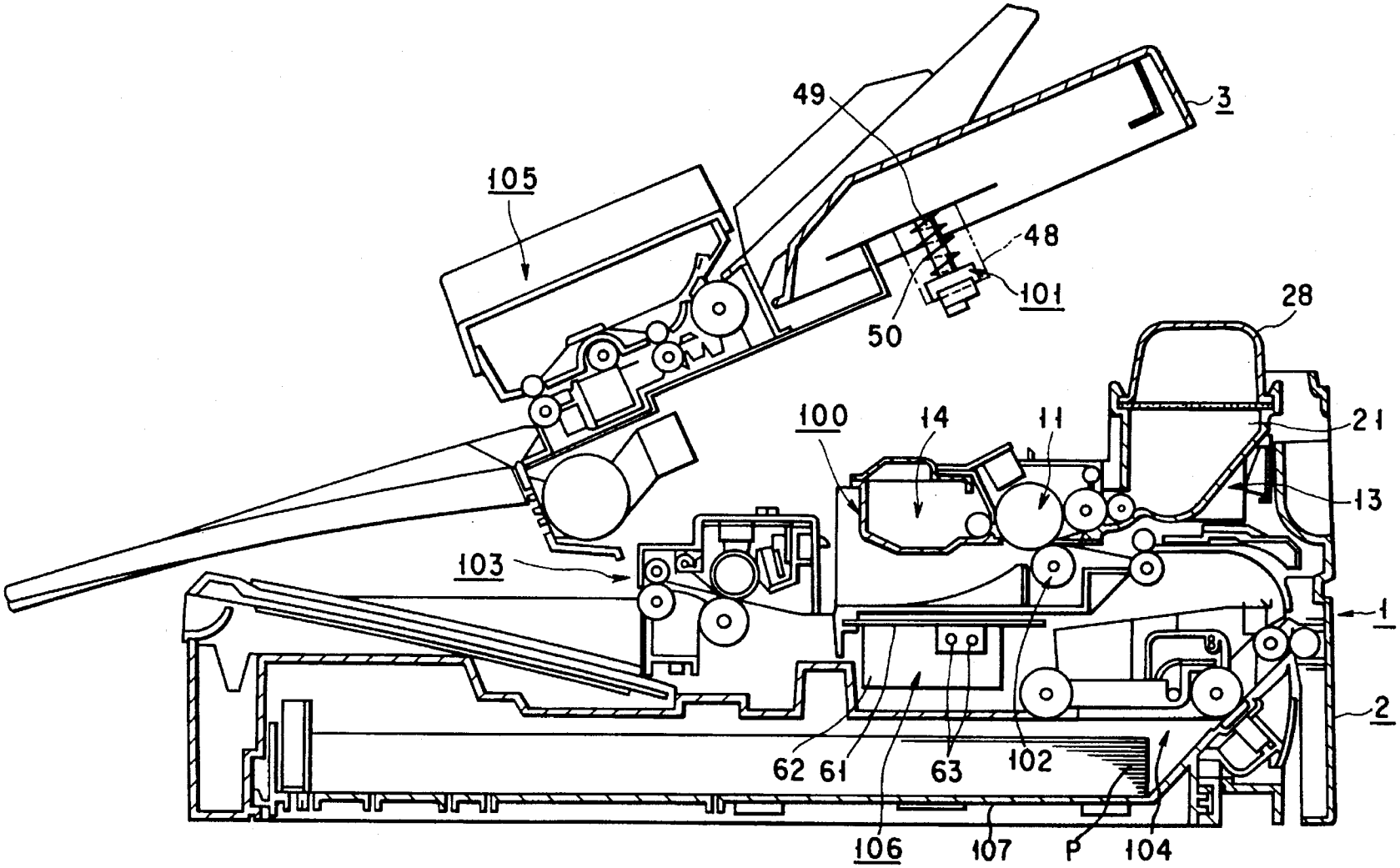
FIG. 2 is a cross-sectional view in which an upper body of the facsimile device of FIG. 1 is opened.

FIG. 1 is a cross section, showing the overall arrangement of a facsimile apparatus according to the embodiment of an electrophotographic device. A main body 1 is divided into a lower body 2 having an upper opening, and an upper body 3 having a lower opening. The upper body 3 is rotatably connected to the lower body 2 at one side thereof such that the upper body 3 can be swung up, as shown in FIG. 2. The upper opening of the lower body 2 can be opened/closed by swung up/down the upper body 3.

The lower body 2 comprises a process unit 100, a transfer unit 102, a fixing unit 103, a sheet feeder unit 104, and a power source unit 106. The upper body 3 comprises an exposure unit 101 and a transmission unit 105.

The process unit 100 comprises a photosensitive drum 11, a charger 12, a developer 13, and a cleaner 14, which are formed integral as one body. The process unit 100 together with the exposure unit 101 forms a toner image on the surface of the photosensitive drum 11 by means of the so-called Carlson process. The process unit 100 is detachably mounted in the lower body 2. Thus, the photosensitive drum 11 as well as the charger 12, the developer 13, and the cleaner 14 can be easily replaced.

The exposure unit 101 has a main body 45 including an LED array (not shown) formed of plural LEDs arranged in a line and a rod lens array (also not shown) attached to the LED array. The LED array emits a light beam in accordance with an image signal and the rod lens array focuses the light beam on the photosensitive surface of the drum 11, thereby forming a latent image thereon.

Figure 6A:
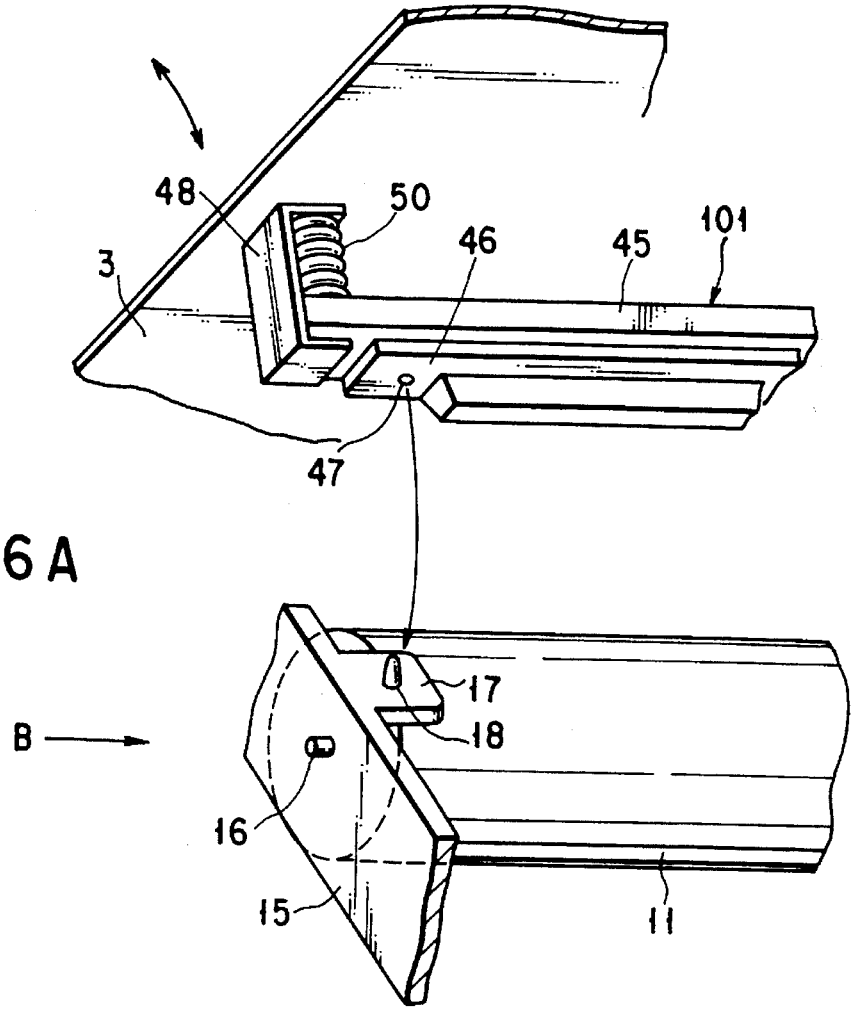
FIGS. 6A and 6B are views showing how the process unit and the exposure unit contact each other.

The exposure unit 101 is connected to the upper body 3 in parallel with the photosensitive drum 11 which is arranged in the lower body 2. Therefore, the exposure unit 101 is positioned just above the photosensitive drum 11 when the upper body 3 is rotated downward to close the upper opening of the lower body 2. The exposure unit 101 is fixed to the upper body 3 at both ends by using metallic holding members 48. Each holding member 48 has a shaft 49 extending in the vertical direction when the upper body 3 is in its closed position, and a torsional coil spring 50 held by the shaft 49. As shown in FIG. 6A, the main body 45 of the exposure unit 101 is fitted to the shaft 49 such that it can be freely moved along the shaft 49 and the main body 45 is usually urged downward by the coil spring 50.

Figure 3:
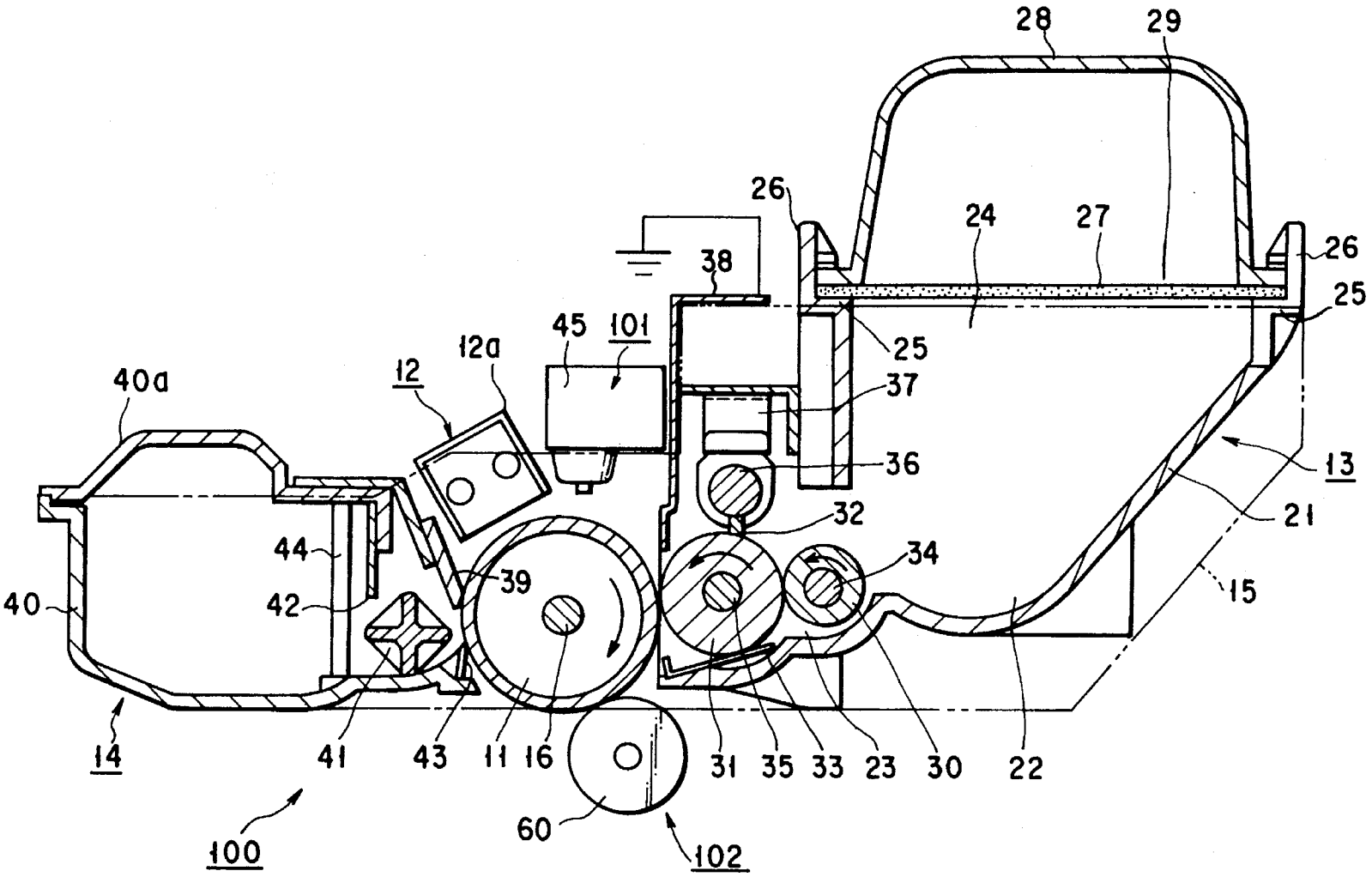
FIG. 3 is a cross-sectional view, showing in detail the structure of a process unit included in the facsimile device of FIG. 1.

As shown in FIG. 3, the transfer unit 102 has a cylindrical transfer roller 60 located below and parallel with the photosensitive drum 11, and transfers a toner image from the drum 11 to a recording sheet of paper P fed from a sheet tray 107 by means of the sheet feeder unit 104.

The fixing unit 103 fixes the toner image which is transferred onto the sheet of paper. The shaft (not shown) connecting the upper body 3 and the lower body 2 is provided in the proximity of the fixing unit 103.

The communication unit 109 optically reads the image of a document to be transmitted, and generates an image signal through photoelectric conversion.

The power source unit 106, which supplies power to the charger 12, the developer 13, and the transfer unit 102, comprises a high voltage power source substrate 61 and a high power source circuit 62 mounted thereon. An output variable volume 63, for varying an output to be supplied to each unit, is provided at that end of the substrate 61 which is located on the front side thereof.

The details of the process unit 100 will be described with reference to FIG. 3. In FIG. 3, elements similar to those shown in FIG. 1 are denoted by the same reference numerals.

In the process unit 100, the charger 12, the developer 13, and the cleaner 14 are provided around the photosensitive drum 11, and are supported as one body by unit plates 15 located on the right and left sides of the process unit 100.

The photosensitive drum 11 comprises, for example, an aluminum cylinder and a photosensitive layer made of a photosensitive conductive material and formed on the aluminum cylinder. The drum 11 has a width longer than the maximum width of the sheet of paper which is able to be used by this facsimile apparatus. An axis 16 is inserted into the drum 11. The drum 11 is attached to unit plates 15 by the axis 16 and is rotatable by a rotary driving mechanism (not shown) in a counter-clockwise direction indicated by the arrow shown in FIG. 3.

The charger 12 is arranged in parallel to the photosensitive drum 11 and comprises a long scorotron shield case 12*a* and a discharge wire therein. This type of the charger 12 is called a scorotron charger. The charger 12 uniformly charges the surface of the drum 11 to keep it at a predetermined potential.

The developer 13 has a case 21, a toner pack 28, a supply roller 30, a development roller 31, a development blade 32, a receiving blade 33, a support bar 36, a spring member 37, and an auxiliary member 38.

The case 21 has substantially the same width as the photosensitive drum 11, and is located parallel to the photosensitive drum 11. The case 21 houses a toner holder 22, and a roller-located portion 23 between the toner holder 22 and the drum 11. The toner holder 22 is communicated with the roller-located portion 23.

The case 21 has an upper surface in which a rectangular toner inlet 24 is formed in the axial direction of the photosensitive drum 11. A horizontal flange 25 is formed around the toner inlet 24, on which an elastic seal member 27 made of e.g. sponge is adhered so as to surround the toner inlet 24. Vertical ribs 26 are formed in the longitudinal direction of the toner inlet 24 so as to fix the toner pack 28.

The toner pack 28 is made of a synthetic resin, and has a shape of a rectangular parallelepiped with substantially the same length as the toner inlet 24. A toner outlet 29 is formed in the lower surface of the pack 28. The pack 28 is filled with toner (not shown), and the toner outlet 29 is sealed by means of a seal sheet (not shown) made of a resin film.

The toner pack 28 is detachably attached to that surface of the case 21 with the toner inlet 24. In order to detachably attach the pack 28 to the case 21, the pack 28 may have a claw to which an engagement portion in the case 21 is engaged.

The roller-located portion 23 contains the supply roller 30, the development roller 31, the development blade 32, and the receiving blade 33.

The supply roller 30 is made of a synthetic resin, and is secured to a roller shaft 34. The development roller 31 is made of a synthetic resin, and is secured to a roller shaft 35. The roller shafts 34 and 35 are rotatably supported by side walls of the case 21. The development roller 31 contacts the supply roller 30 and the photosensitive drum 11.

The supply roller 30 and the development roller 31 are rotated by a rotating mechanism (not shown) in a counter-clockwise direction indicated by the arrows in FIG. 3. The supply roller 30 transfers toner from the toner holder 22 to the development roller 31, which in turn transfers the received toner to the photosensitive drum 11.

The development blade 32 is made of a synthetic resin, and is secured to a bottom portion of the holding bar 36 such that the blade extends downward. The holding bar 36 is located above and parallel with the development roller 31, and is supported by the side walls of the case 21 in such a manner that the bar 36 can be moved in the vertical direction.

The spring member 37 urges the holding bar 36 downward. Thus, the development blade 32 contacts the development roller 31 to flatten the toner carried on the roller 31, thereby forming a thin layer of toner, which is charged as a result of friction.

The receiving blade 33 is formed of, e.g., an elastic resin, and is located close to the photosensitive drum 11 and under and parallel with the development roller 31. The blade 33 has one end attached to a bottom portion of the case 21, and the other end contacts the surface of the development roller 31. The blade 33 serves to prevent toner contained in the roller-located portion 23, from escaping downward from the development roller 31 to the outside of the case 21, and also to guide toner dripped from the development roller 31, into the case 21 in accordance with the rotation of the development roller 31.

The auxiliary member 38 is arranged between the exposure unit 101 and the development roller 31 in the longitudinal direction of the roller 31, and is attached to the unit plates 15. The member 38 separates the development roller 31 from the exposure unit 101. Further, the member 38 is grounded, when the process unit 100 is mounted in the lower body 2, to attract toner which has an electrostatic force, thus preventing the toner from escaping from the development unit 13.

The cleaner 14 has a cleaning blade 39, a used-toner receiving tank 40, a toner transfer roller 41, a one-way valve 42, a receiving blade 43, and a rib 44. The cleaning blade 39 scrapes off used-toner remaining on the photosensitive drum 11 after the transfer unit 102 performs the transfer process. The used-toner receiving tank 40 receives used-toner scraped by the cleaning blade 39. The tank 40 has an upper opening and a cover **40*a* closing the opening. The toner transfer roller 41 transfers used-toner scraped by the cleaning blade 39, into the tank 40. The one-way valve 42 prevents used-toner in the tank 40 from returning to the photosensitive drum 11. The receiving blade 43 receives used-toner scraped off by the cleaning blade 39, and guides used-toner into the tank 40. The rib 44 supports the bottom of the tank 40 and the cover 40*a*, and prevents them from warping when they receive a rotational force that is applied from the photosensitive drum 11 via the cleaning blade 39 and the receiving blade 43. As a result, the amount of bite of the cleaning blade 39 into the drum 11, and the distance between the cleaning blade 39 and the receiving blade 43** can be maintained constant, thereby enhancing the cleaning performance.

The toner transfer roller 41 is located in the longitudinal direction of the photosensitive drum 11, and can be rotated about the axis thereof. The one-way valve 42 is attached to the cover **40*a* in the longitudinal direction of the transfer roller 41. The lower edge of the valve 42 is located above the axis of the transfer roller 41, so as to prevent the one-way valve 42 from interrupting the transfer of used-toner to the used-toner receiving tank 40 with the transfer roller 41**.

The process unit 100 constructed as described above is mounted in the lower body 2.

Figure 4A:
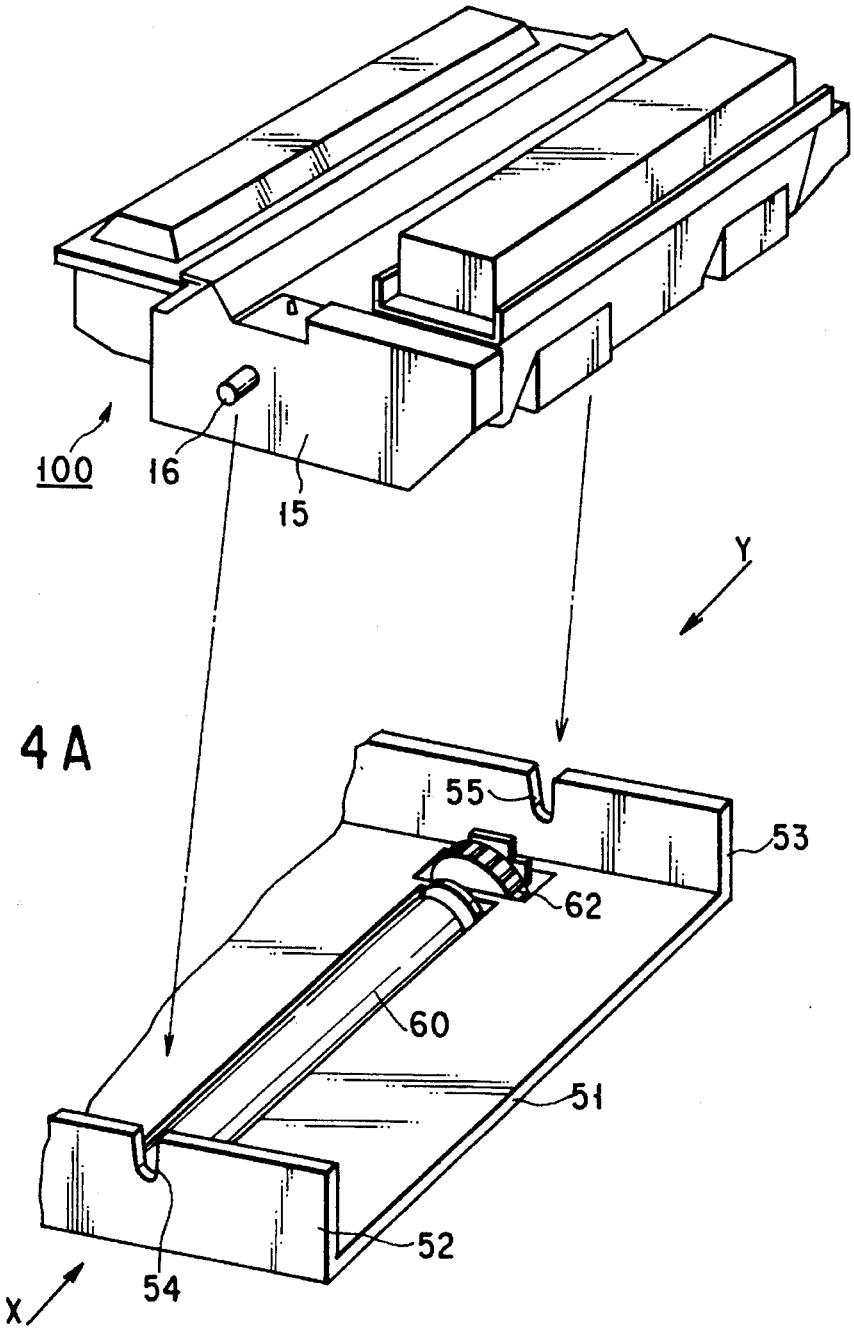
FIGS. 4A, 4B, and 4C show how the process unit is mounted in a lower body of the facsimile device of FIG. 1.
Figure 5:
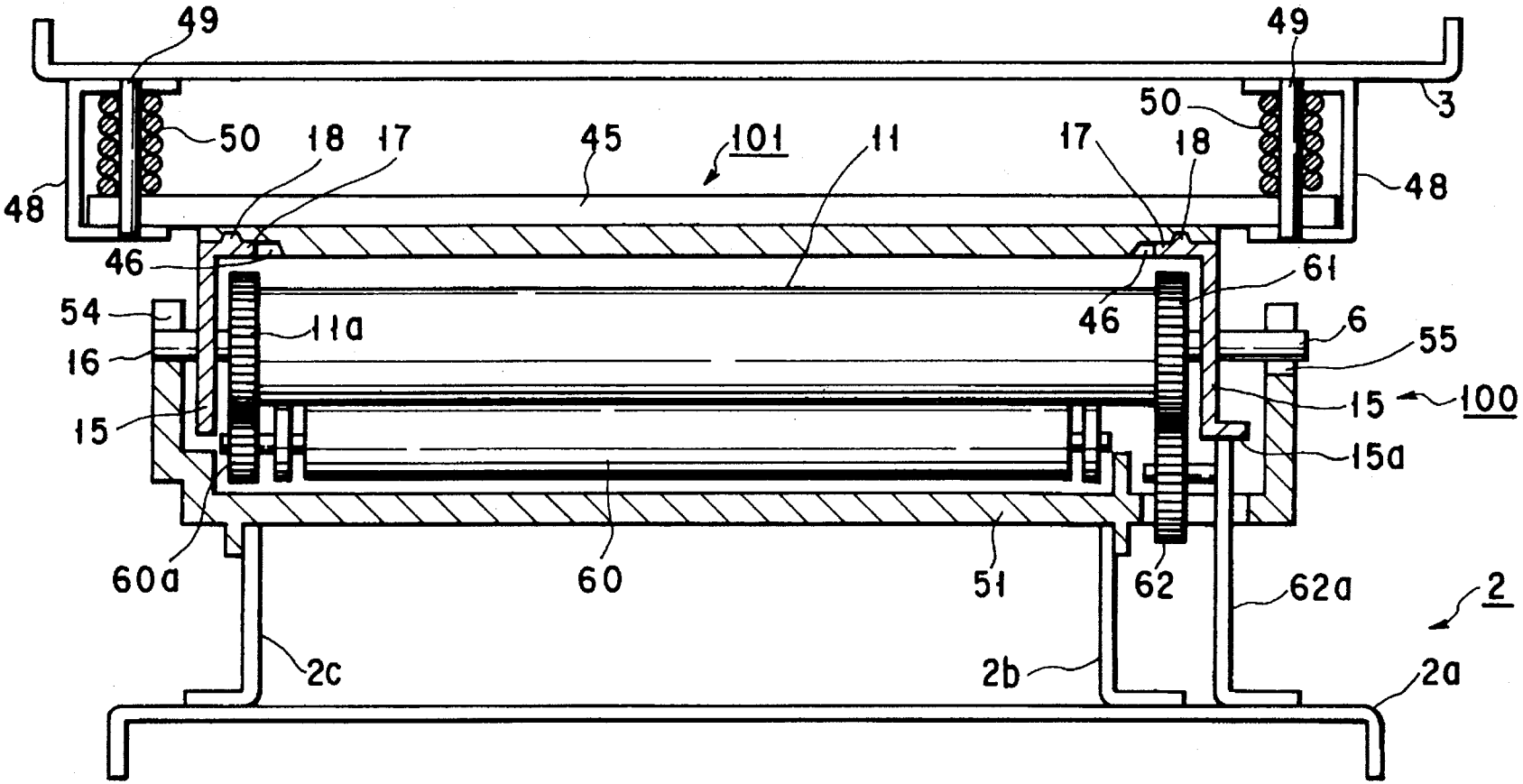
FIG. 5 is a cross-sectional view showing how the lower body, the process unit, and an exposure unit contact one another in the facsimile device of FIG. 1.

FIG. 4A shows how the process unit 100 is mounted in the lower body 2. The transfer roller 60 is attached to a supporting member 51 which is supported by side plates **2*b* and 2*c* on a base plate 2*a* of the lower body 2, as shown in FIG. 5. The member 51 has wall portions 52 and 53 at both ends of the transfer roller 60. The wall portions 52 and 53 have U-shaped grooves 54 and 55, respectively. The process unit 100 is mounted in the lower body 2 by placing the ends of the drum shaft 16 of the photosensitive drum 11 in the grooves 54 and 55**.

Figure 4B:
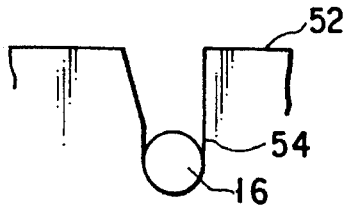
Figure 4C:
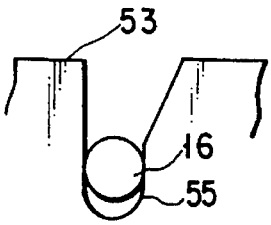

As is shown in FIGS. 4B and 4C, the groove 54 is shallower than the groove 55. FIG. 4B is viewed from the direction x and FIG. 4C is viewed from the direction Y. Accordingly, the groove 54 controls the vertical and horizontal positions of the drum shaft 16, whereas the groove 55 controls only the horizontal position thereof.

The vertical position of the drum shaft 16 at the end of the wall portion 53 controlled is as follows. FIG. 5 is a cross-sectional view, showing a state in which the upper body 3 is rotated downward and is in the closed position (as shown in FIG. 1). In this state, the exposure unit 101 is in contact with the process unit 100, which in turn is in contact with the lower body 2.

The lower body 2 has a base member **2*a*, and side plate members 2*b* and 2*c*, which are secured onto and extend upward from the base member 2*a*. The support member 51 is fixed to the side plate members 2*a* and 2*b***.

The photosensitive drum 11 mounted in the process unit 100 has one end to which a driven gear (following gear) 61 is attached. A rotating-driving unit (not shown) is mounted in the lower body 2, and a driving gear 62, as a part of the rotating unit, is supported by a support member **62*a* for the rotating-driving unit, which is secured to the base member 2*a* of the lower body 2. The upper end of the support member 62*a* contacts a contact portion 15*a* formed at the lower end of one of the unit plate 15 when the upper body 3** is rotated downward.

As is shown in FIG. 6A, contact portions 17, which are provided on each upper end portion of the unit plate 15 of the process unit 100, horizontally extend from both ends of the photosensitive drum 11. Positioning pins 18 project from the upper surface of each of the contact portions 17.

Figure 6B:
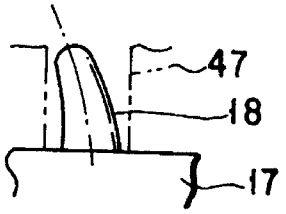

Stepped contact portions 46 are formed on the lower surface of the exposure unit body 45. Each contact portion 46 is brought into contact with a corresponding one of the contact portions 17 when the upper body 3 is rotated downward to its closed position. Positioning holes 47, which are formed in the lower surfaces of the contact portions 46, are such that they can be engaged with the positioning pins 18. As is shown in FIG. 6B, the positioning pins 18 are curved to coincide with the arc obtained when the exposure unit body 45 together with the upper main body 3 is rotated with a shaft provided at the fixing unit 103 as the center. Therefore, it is easy to engage the pins 18 with the holes 47 and to disengage the pins 18 from the holes 47. FIG. 6B is viewed from the direction B of FIG. 6A.

Thus, rotating downward the upper body 3 causes the exposure unit 101 to approach the photosensitive drum 11. Closing the opening of the lower body 2 with the upper body 3 brings the lower surfaces of the contact portions 46 of both end portions of the exposure unit body 45, into contact with the upper surfaces of the contact portions 17 of the unit plates 15.

The exposure unit body 45 is urged downward by the coil spring 50. The urging force of the spring 50 is stopped by the casing 48. Further, when the contact portions 46 contact the contact portions 17, the spring 50 slightly compresses and the exposure unit body 45 is prevented from moving further downward. Thus, the body 45 is kept in a predetermined position, separated from the photosensitive drum 11 by a predetermined distance which is determined by the height of the contact portions 17. In other words, the exposure unit 101 is positioned in the vertical direction relative to the drum 11 mounted in the process unit 100, i.e., in the diametrical direction of the drum 11.

Although the upper body 3 closes the opening of the lower body 2 with a certain degree of play, this play can be eliminated by the structure wherein the exposure unit body 45 is movable in the vertical direction of a shaft 49 of the spring 50.

When the contact portions 46 of the exposure unit body 45 contact the contact portions 17 of the unit plates 15, the positioning pins 18 are fitted in the positioning holes 47 of the contact portions 17. Thus, the body 45 is prevented from moving in the horizontal direction relative to the photosensitive drum 11. Since, as described above, the pins 18 are curved to coincide with the arc obtained when the exposure unit body 45 together with the upper main body 3 is rotated, they can be fitted smoothly into the holes 47. The body 45 is, therefore, accurately positioned relative to the drum 11. Though the exposure unit 101 employs an LED array and hence has a depth of focus as shallow as, e.g., ±0.1 mm in the present invention, the focal point of the unit 101 can be accurately positioned on the drum 11 by means of the positioning method as shown in FIG. 5.

It is to be noted that the pins 18 and the holes 47 may be provided at the exposure unit body 45 and the contact portions 17.

As described above, when the exposure unit body 45 urged by the coil spring 50 contacts the process unit 100, the process unit 100 is also urged downward. Then, as shown in FIG. 4A, one end of the drum shaft 16 is brought into contact with the bottom of the U-shaped groove 54 of the support member 51, thereby positioning one end of the process unit 100. On the other hand, the other end of the process unit 100 corresponding to the groove 55 is positioned as a result of the contact portion 15*a* of the unit plate 15 being brought into contact with the driving-side support member 62*a*, as shown in FIG. 5.

The driven gear 61 and the driving gear 62 are disposed to be engaged with each other when the contact portion 15*a* is brought into contact with the support member 62*a*. Accordingly, positioning the process unit 100 by bringing the contact portion 15*a* into contact with the support member 62*a* engages the gear 61 with the gear 62. Relative positioning of the gears 61 and 62 can be performed very accurately since it results from direct contact between the unit plate 15 supporting the photosensitive drum 11 and the follower gear 61 and the support member 62*a* supporting the driving gear 62. Thus, the gears 61 and 62 are accurately engaged with each other.

Figure 7:
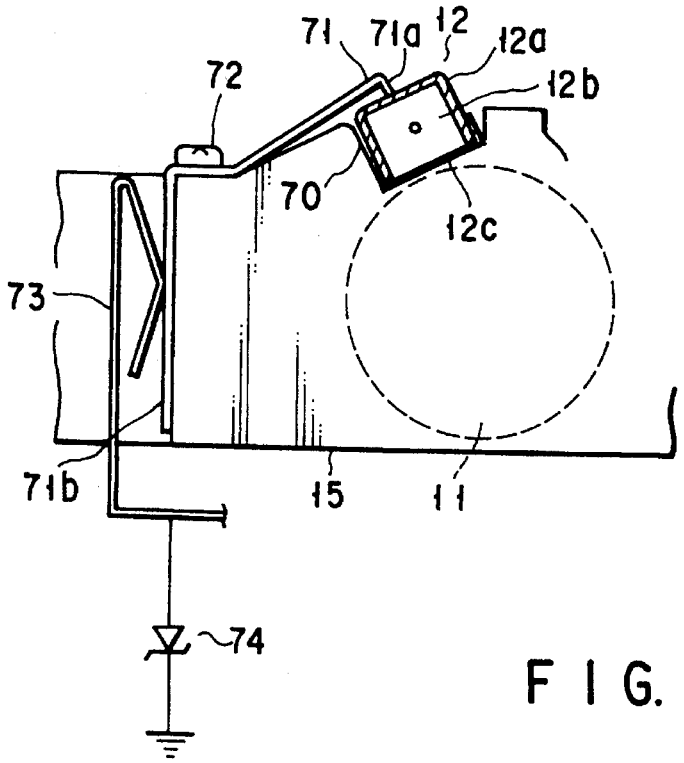
FIG. 7 is a side view, showing how a charger is fixed to the drum and how the scorotron shield case of the charger is grounded in the facsimile device of FIG. 1.
Figure 8:
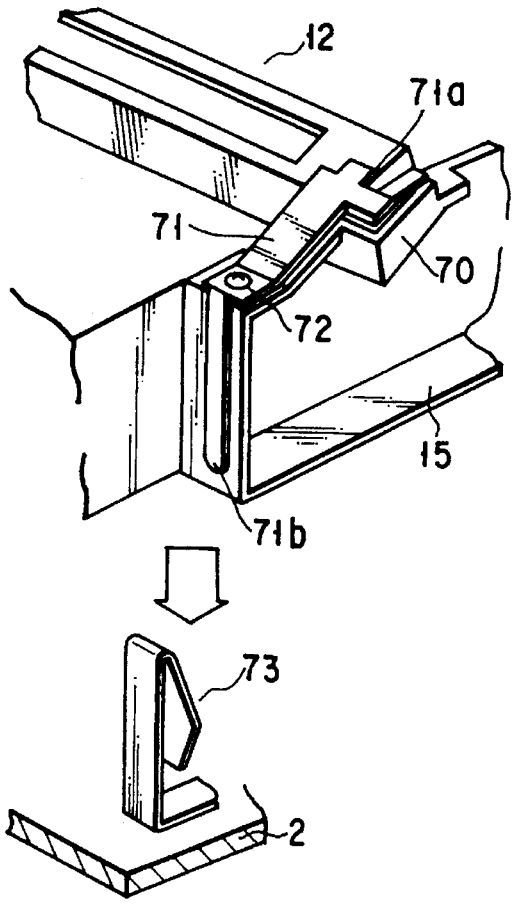
FIG. 8 is a perspective view, showing how the charger is fixed.

FIG. 7 is a side view, showing how the charger 12 is fixed to the process unit 100 and how the scorotron shield case 12*a* of the charger 12 is grounded, while FIG. 8 is a perspective view, showing how the charger 12 is fixed to the process unit 100.

As is shown in FIG. 7, the charger 12 has a scorotron shield case 12*a* having a U-shaped cross section, a discharge wire 12*b*, and a grid 12*c* attached to the opening of the U-shaped shield case 12*a*. The scorotron shield case 12*a* is a slim boxlike case made of a conductive material, and has the inner discharge wire 12*b* extended in the longitudinal direction thereof. This case 12*a* has an opening facing to the drum 11, in which the grid 12*c* is mounted. The grid 12*c* is made of a conductive material and is electrically connected to the scorotron shield case 12*a*.

The scorotron shield case 12*a* is supported at both ends by charger located portions 70 formed on the unit plates 15, and is urged against the portions 70 by means of fixing members 71.

The fixing member 71 is a plate member made of a conductive material, and is secured to the unit plate 15 by use of a screw 72. The member 71 has a bent end 71*a*, and urges the scorotron shield case 12*a* by means of its elastic force to the charger located portion 70. The member 71 and the case 12*a* are electrically connected to each other.

The fixing member 71 has an end 71*b* opposite to the end 71*a* and extending along the upper and side surfaces of the unit plate 15. A contact 73 is attached to the lower body 2 such that the contact 73 and the end 71*b* of the fixing member 71 are in contact with each other when the process unit 100 is mounted in the lower body 2. The contact 73, which is formed of a conductive material plate member bent like a spring contact and made of a conductive material, is grounded via a Zener diode 74.

When the process unit 100 is mounted in the lower body 2, the grid 12*c* of the charger 12 is grounded via the scorotron shield case 12*a*, fixing member 71, contact 73, and Zener diode 74*i*. Since the fixing member 71 also serves as an electrode for grounding the grid 12*c* and scorotron shield case 12*a*, a particular electrode in addition to the fixing member is not necessary. Hence the number of components required, and thus the manufacturing cost, can be reduced.

According to the present invention, there is provided an electrophotographic device in which the position of a photosensitive drum is maintained constant with respect to the upper body and lower body and an upper body so that a high quality image is obtained. Further, according to the present invention, there is provided an electrophotographic device in which an electrical connection between the charger and the main body is easily performed when the charger as well as the photosensitive drum are mounted to the main body.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. For example, it is not necessary to rotatably connect the upper body with the lower body. The upper body may be completely detached from the lower body when a used process unit is replaced with a new one. Further, it is not necessary to integrate the photosensitive drum, the developer, or the like into the process unit. Merely, the photosensitive drum may be detachably provided in the lower body. The electrophotographic device is not limited to the facsimile device but may be applied to a copying machine, a laser beam printer, an LED printer, or the like. The type of the electrophotographic scheme is not limited to the above mentioned type. For example, the charger is not limited to the scorotron charger. A corotron charger may be used. In this case, a corotron shield case is directly grounded without connecting the Zener diode.

What is claimed is:

1. A process unit used for an electrophotographic device, the process unit being detachably mounted in a main body of the electrophotographic device including exposure means for emitting light in accordance with an image, driving means for providing a rotational force, and first supporting means for supporting said driving means, the process unit comprising:

a photosensitive member, on which a latent image is formed by the light emitted from said exposure means, the photosensitive member being driven by the rotational force provided from said driving means; and second supporting means for supporting said photosensitive member, the second supporting means including a first positioning member for contacting said first supporting means and a second positioning member for contacting said exposure means.

2. The process unit according to claim 1, wherein said second positioning member comprises engaging means for engaging with said exposure means.

3. The process unit according to claim 2, wherein said engaging means comprises one of a recess and a projection engaged with the recess and said exposure means comprises an other of the recess and the projection.

4. The process unit according to claim 1, wherein said main body of the electrophotographic device comprises a first body and a second body, said exposure means being arranged in the first body in a state in which said exposure means is urged to the second body.

5. The process unit according to claim 4, wherein said first body is rotatably connected to said second body between a closed position and an open position.

6. An electrophotographic device comprising:

exposure means for emitting light in accordance with an image;

driving means for providing a rotational force;

first supporting means for supporting said driving means; and a process unit including:

a photosensitive member, on which a latent image is formed by the light emitted from said exposure means, the photosensitive member being driven by the rotational force provided from said driving means; and second supporting means for supporting said photosensitive member, the second supporting means having a first positioning member for contacting said first supporting means and a second positioning member for contacting said exposure means.

7. The electrophotographic device according to claim 6, wherein said second positioning member comprises engaging means for engaging with said exposure means.

8. The electrophotographic device according to claim 7, wherein said engaging means comprises one of a recess and a projection engaged with the recess and said exposure means comprises an other of the recess and the projection.

9. The electrophotographic device according to claim 6, wherein a main body of the electrophotographic device comprises a first body and a second body, said exposure means being arranged in the first body in a state in which said exposure means is urged to the second body.

10. The electrophotographic device according to claim 9, wherein said first body is rotatably connected to said second body between a closed position and an open position.

11. A process unit used for an electrophotographic device, the process unit being detachably mounted in a main body of the electrophotographic device, the process unit comprising:

a photosensitive member;

a charger for charging a surface of the photosensitive member, the charger including a discharge wire and a shield case, the discharge wire being spaced from the photosensitive member and the shield case containing the discharge wire;

a support member for supporting the photosensitive member and the charger; and a first conductive member arranged on said support member, the first conductive member having a first portion and a second portion, the first portion being electrically connected to the shield case and the second portion contacting a second conductive member disposed in the main body of the electrophotographic device when the process unit is mounted in the main body of the electrophotographic device.

12. The process unit according to claim 11, wherein said first portion contacts the shield case of said charger.

13. The process unit according to claim 11, wherein said support member includes a recess portion for receiving said charger and the first portion of said first conductive member urges said charger toward the recess portion.

14. The process unit according to claim 11, wherein said charger is a scorotron charger and the second portion is connected to a ground potential through a constant voltage element.

15. The process unit according to claim 11, wherein said charger is a corotron charger and the second portion is connected to a ground potential.

16. An electrophotographic device comprising:

a photosensitive member;

a charger for charging a surface of the photosensitive member, the charger including a discharge wire and a shield case, the discharge wire being spaced from the photosensitive member, and the shield case containing the discharge wire;

a support member for supporting the photosensitive member and the charger, the support member being detachably mounted in a main body of the electrophotographic device; and a first conductive member arranged on said support member, the first conductive member having a first portion and a second portion, the first portion being electrically connected to the shield case and the second portion contacting a second conductive member disposed in the main body of the electrophotographic device when said support member is mounted in the main body of the electrophotographic device.

17. The electrophotographic device according to claim 16, wherein said first portion contacts the shield case of said charger.

18. The electrophotographic device according to claim 16, wherein said support member includes a recess portion for receiving said charger and the first portion of said first conductive member urges said charger toward the recess portion.

19. The electrophotographic device according to claim 16, wherein said charger is a scorotron charger and the second portion is connected to a ground potential through a constant voltage element.

20. The electrophotographic device according to claim 16, wherein said charger is a corotron charger and the second portion is connected to a ground potential.

* * * * *